US008375760B2

(12) United States Patent
Haak

(10) Patent No.: US 8,375,760 B2
(45) Date of Patent: Feb. 19, 2013

(54) MAKING AND COILING ROD AND WIRE

(75) Inventor: Peter Haak, Willich (DE)

(73) Assignee: SMS MEER GmbH, Moenchengladbach (DE)

( * ) Notice: Subject to any disclaimer, the term of this patent is extended or adjusted under 35 U.S.C. 154(b) by 1134 days.

(21) Appl. No.: 12/173,462

(22) Filed: Jul. 15, 2008

(65) Prior Publication Data

US 2009/0019910 A1 Jan. 22, 2009

(30) Foreign Application Priority Data

Jul. 16, 2007 (DE) ..... 10 2007 032 987

(51) Int. Cl.
*B21B 37/48* (2006.01)
*B21B 37/74* (2006.01)

(52) U.S. Cl. ..... 72/202; 72/12.3; 72/201

(58) Field of Classification Search ..... 72/256, 72/234, 137, 202, 203, 8.6, 11.4, 12.3, 16.6, 72/18.4, 19.2; 242/361, 361.1, 361.2, 361.4, 242/362, 362.1

See application file for complete search history.

(56) References Cited

U.S. PATENT DOCUMENTS

| | | | | |
|---|---|---|---|---|
| 4,759,207 | A * | 7/1988 | Hawkes | 72/257 |
| 4,891,963 | A | 1/1990 | Reumann | 72/203 |
| 5,463,886 | A | 11/1995 | Seitz | 72/13 |
| 5,934,536 | A | 8/1999 | Shore et al. | 226/177 |
| 5,944,275 | A | 8/1999 | Hauck | 242/361 |

FOREIGN PATENT DOCUMENTS

| | | |
|---|---|---|
| DE | 2437684 | 2/1976 |
| DE | 3039101 | 5/1982 |
| DE | 3628151 | 2/1988 |
| GB | 2178981 | 2/1987 |

* cited by examiner

*Primary Examiner* — Debra Sullivan
(74) *Attorney, Agent, or Firm* — Andrew Wilford

(57) ABSTRACT

A method of making wire has the steps of rolling out a wire in a mill having a finishing stand from which the wire exits at a predetermined and varying travel speed $V_D$, pulling the wire through a cooling/equalizing stretch downstream in a travel direction from the finishing stand by means of a cooler drive at a downstream end of the finishing stretch such that the wire exits the cooler drive substantially at the travel speed $V_D$, passing the wire through a looping stretch downstream of the cooler drive to a looper drive, operating the looper drive at such a speed that the wire forms a loop between the cooler drive and the looper drive and exits the looper drive at a looper speed $V_T$ normally different from the travel speed $V_D$, and forming the wire into turns and depositing the turns as a coil downstream of the looper drive.

12 Claims, 2 Drawing Sheets

MAKING AND COILING ROD AND WIRE

FIELD OF THE INVENTION

The present invention relates to a method of and apparatus for making rod and wire. More particularly this invention concerns such an apparatus that produces finished coils of the rod/wire.

BACKGROUND OF THE INVENTION

Wire, which term here is intended also to cover rod, is rolled in at least one finishing frame or stand of a wire mill. The rolled wire then passes through a cooling and/or equalizing stretch downstream of the last finishing stand in the travel direction, where the wire, which is very hot from the rolling operation, cools somewhat and its temperature and crystalline structure stabilize and become uniform. The wire is pulled through the cooling and/or equalizing stretch by means of a cooler drive typically provided at the downstream end of the cooling and/or equalizing stretch. Downstream of the cooler drive a coiler for the wire deposits the wire in turns that may overlap or form a coil on a support, typically a conveyor moving slowly downstream from the coiler. See U.S. Pat. No. 5,463,886 as well as DE 2,437,684 and DE 3,039,101.

The wire to be coiled is produced in a number of finishing stands each normally having two rollers that transversely compress (and thereby longitudinally lengthen) the workpiece as it moves downstream until it has the desired diameter. Since the transverse compression lengthens the wire, it leaves the train of rolling stands or stands at a relatively high travel speed.

Figure 1:
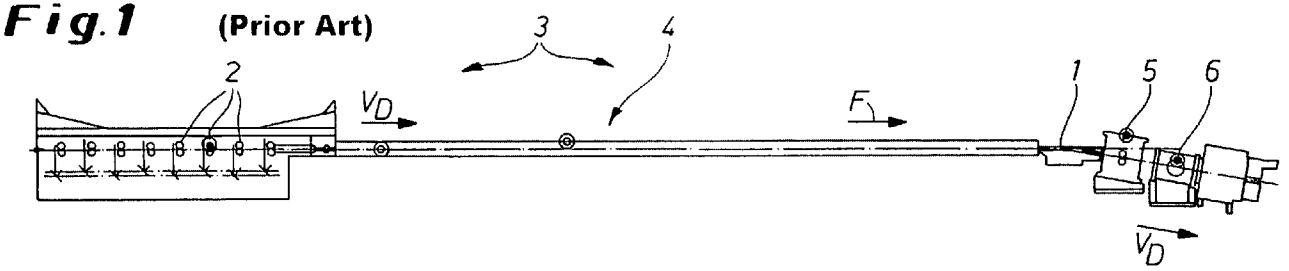
Fig.1 (Prior Art)
FIGS. 1 and 2 are small-scale schematic side views of prior-art systems.
Figure 2:
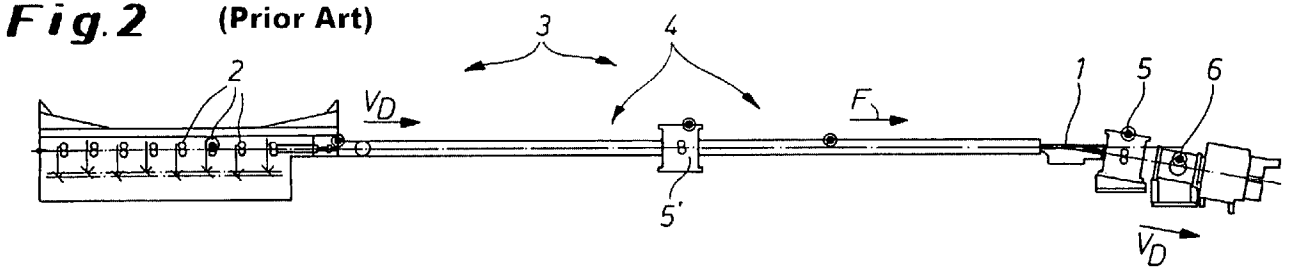
Fig.2 (Prior Art)

Typical prior-art systems are shown in FIGS. 1 and 2. Here a wire mill 3 has a number of rolling stands 2 that function as described above to produce a wire 1 that exits the furthest downstream stand 2 at the desired caliber and at a travel speed $V_D$. Then the wire 1 travels downstream in a travel direction F through a straight stretch 4 in which it is cooled, the wire's temperature becomes uniform throughout its cross section, and its structure stabilizes.

The wire 1 is pulled through the stretch 4 by a cooler drive 5, typically formed as a pair of rolls or a capstan that grip the wire 1, at the speed $V_D$. FIG. 2 shows how a second cooler drive 5' can be provided roughly in the middle of the cooling/equalizing stretch 4 to maintain the wire speed at $V_D$ and to keep the wire 1 tensioned as it cools.

Downstream in the direction F from the cooler drive 5 the wire is passed to a coiler 6 that deposits it in turns forming a coil on an output conveyor, table, or the like.

The problem is that the wire travel speed $V_D$ is not constant but varies inherently because of the nature of producing wire by rolling, where combined factors of tension and compression are used to produce a product whose size must comply with exact standards. Thus the rolls of the stands 2 are normally driven by meticulously controlled drives that operate with feedback from upstream and downstream sensors so that the finished product is perfect, albeit moving at a somewhat varying speed $V_D$ that, as mentioned above, must vary. Even the cooler drive 5 is normally controlled to operate at varying speed to maintain the wire 1 under tension in the stretch 4.

As a result the turns produced by the coiler 6 are not uniform. When the wire 1 is moving too rapidly, the diameters of the turns are too large, and when it is moving too slowly they are too small. Since the speed $V_D$ varies during production, for instance as the equipment heats up, it is therefore impossible to produce coils of uniform size.

OBJECTS OF THE INVENTION

It is therefore an object of the present invention to provide an improved system for making and coiling wire.

Another object is the provision of such an improved system for making and coiling wire that overcomes the above-given disadvantages, in particular that produces coils having turns of uniform controlled size.

SUMMARY OF THE INVENTION

A method of making wire has according to the invention the steps of rolling out a wire in a mill having a finishing stand from which the wire exits at a predetermined and varying travel speed $V_D$, pulling the wire through a cooling/equalizing stretch downstream in a travel direction from the finishing stand by means of a cooler drive at a downstream end of the finishing stretch such that the wire exits the cooler drive substantially at the travel speed $V_D$, passing the wire through a looping stretch downstream of the cooler drive to a looper drive, operating the looper drive at such a speed that the wire forms a loop between the cooler drive and the looper drive and exits the looper drive at a looper speed $V_T$ normally different from the travel speed $V_D$, and forming the wire into turns and depositing the turns as a coil downstream of the looper drive.

According to the invention the looper drive can be regulated such that the loop height is within a predetermined value range between an upper limit and a lower limit.

Preferably, the drive speed of the coiler is also controlled with or without feedback according to the speed of the looper drive.

The wire in the cooling and/or equalizing stretch between the last finishing stand, and the cooler drive is preferably held at a predetermined tension. Furthermore, a further drive is arranged within the cooling and/or equalizing stretch to maintain tension in the wire.

The wire mill according to the invention has a looper drive arranged in the travel direction downstream of the cooler drive and upstream of the coiler. This looper drive can be driven such that the wire forms a loop having a loop height measured relative to a straight target line between the two drives.

For regulating the size of the loop, a sensor is preferably provided for detecting the height of the loop, that is a vertical position of the lowest portion of the loop. Furthermore, a controller is advantageously provided that is connected to the sensor so as to influence a drive motor of the looper drive.

The controller may also influence a drive motor of the coiler to synchronize the working speed of the looper and the coiler.

The proposal according to the invention ensures that using relatively simple means, the wire can be deposited by means of the coiler in turns of constant diameter. Any variations in wire speed, which are present downstream of the finishing stand, can be adjusted out in a simple manner.

The rolling process is thereby decoupled from the coiling.

Wire coils having fewer problems with deviations of the diameters of the turns, and less system downtime are achieved in an advantageous manner.

SPECIFIC DESCRIPTION

Figure 3:
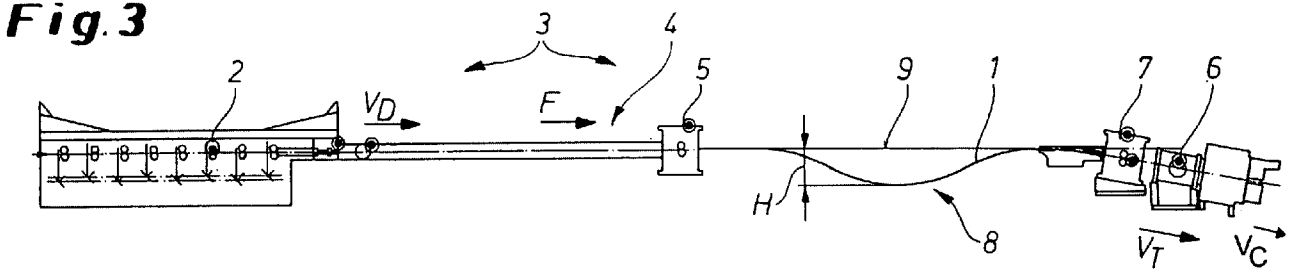
FIG. 3 is a view like FIGS. 1 and 2 of the system according to the invention.

As seen in FIG. 3 a wire mill 3 is provided like that of FIGS. 1 and 2. The wire 1 exits the finishing stands 2 of a finishing block in the travel direction F in order to reach a cooling and equalizing stretch 4. The wire 1 is then pulled through the cooling and equalizing stretch 4 by means of a cooler drive 5 that keeps the wire 1 tensioned while passing through the cooling and equalizing stretch 4. The drive speed of the cooler drive 5 is determined according to the wire speed $V_D$ of the wire 1 downstream of the finishing block. There, the wire 1 has the speed $V_D$, which is not constant, but varies around a median value. The wire 1 reaches a coiler 6 that deposits it in turns in a known manner, for example, onto a conveyor belt, downstream of the cooling and equalizing stretch 4.

The critical factor is that according to the invention a looper drive 7 is arranged in the travel direction F downstream of the cooler drive 5, and upstream of the coiler 6. The two drives 5 and 7 are spaced from each other. The looper drive 7 is selectively operated by a controller 11 so that the wire 1 forms a loop 8 between the two drives 5 and 7. As seen in FIG. 3, the loop 8 has a loop height H, which is measured from a straight or ideal target line 9.

The looper drive 7 outputs the wire 1 at a speed $V_T$, which is kept largely constant, and due to which a constant turn diameter of the wire 1 is formed when it is deposited in turns by the coiler 6. The looper drive 7 is operated at the mainly constant speed $V_T$, and the speed $V_C$ of the coiler 6 is coupled to the drive speed of the looper drive 7, so that the coiler 6 and looper drive 7 operate synchronously.

Any variations of the speed $V_D$ can be balanced in this manner by growth or shrinkage of the loop 8, and the feed of the wire 1 into the coiler 8 occurs by means of the looper drive 7 at a constant speed $V_T$. This leads to an optimum layout, since the winding diameter is constant.

Figure 4:
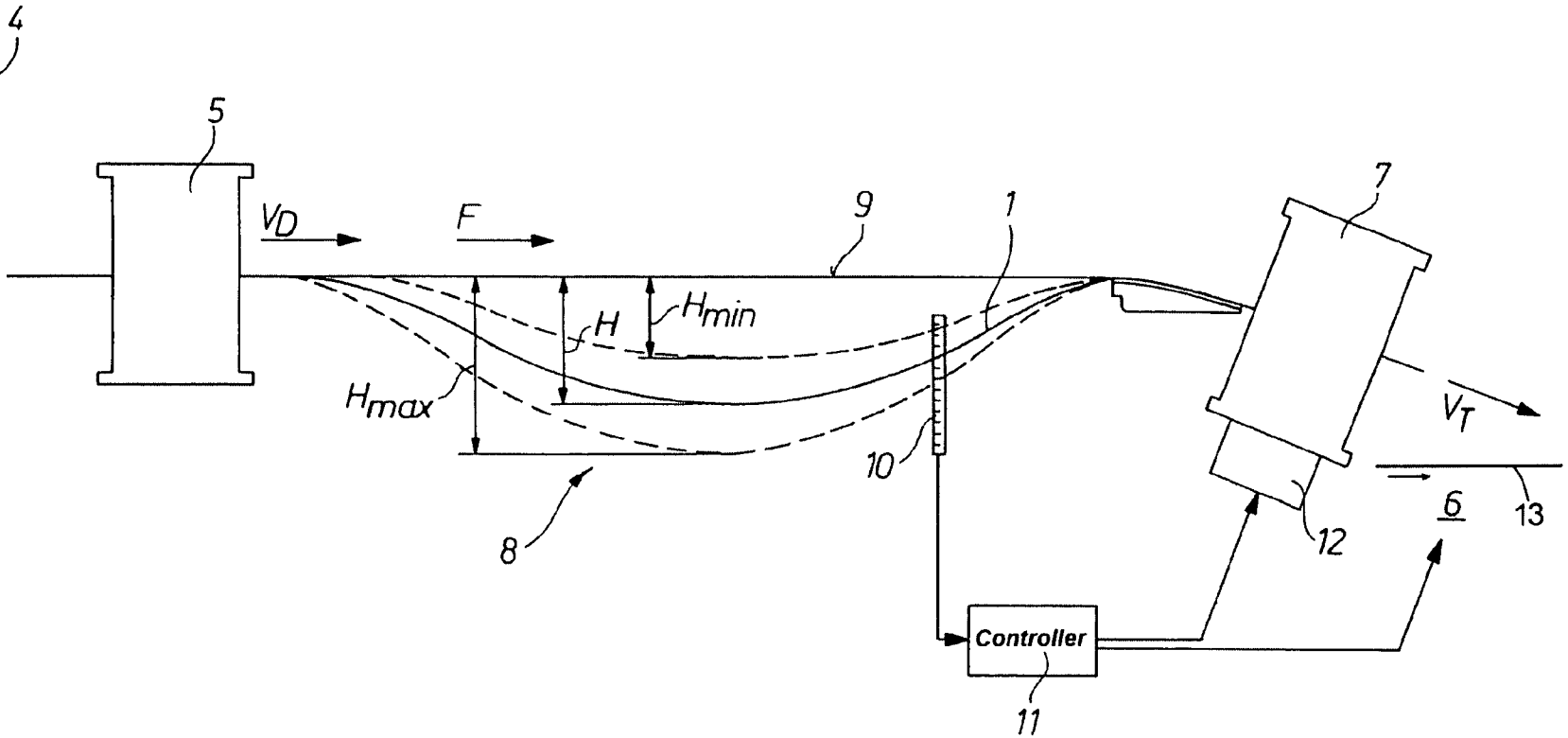
FIG. 4 is a large-scale view of the detail at the right-hand end in FIG. 3.

In this regard, details are illustrated in FIG. 4. As shown, the wire 1 between the two drives 5 and 7 is not guided along the target line 9, but instead forms a loop in the stretch 8. This compensates for most speed variations in the wire speed $V_D$ at the output side of the finishing block. The loop 8 has a loop height H, which may vary between a minimum value $H_{min}$ and a maximum value $H_{max}$ that can be predetermined. The respective courses of the wire 1 are illustrated as dashed lines.

The actual or current value of the loop height H is determined by means of a sensor 10, which may be, for example, a photo sensor capable of measuring the maximum displacement of the wire 1 from the target line 9. The value for the loop height H determined by the sensor 10 is fed to the control means or controller 11.

The controller 11 operates a drive motor 12 of the looper drive 7 such that the loop height H stays within the permissible range, that is between $H_{max}$ and $H_{min}$. If the value for the loop height becomes too high, the drive motor 12 is made to rotate faster, if the value becomes too small, the drive motor 12 becomes slower. The loop height H is therefore maintained at a desired value in the closed loop.

As schematically indicated in FIG. 4, the controller 11 may also influence the drive of the coiler 6 accordingly so that the working speed $V_T$ of the looper drive 7, and the speed $V_C$ of the coiler 6 are synchronized, i.e. $V_T=V_C$. The result is turns placed at uniform winding diameters, normally on a surface 13 of a conveyor that is moving downstream, again at a speed that is synchronized to that of the coiler 6 and looper 7.

I claim:

1. A method of making wire comprising the steps of:

rolling out a wire in a mill having a finishing stand from which the wire exits at a predetermined and varying travel speed $V_D$;

pulling the wire through a cooling/equalizing stretch downstream in a travel direction from the finishing stand by means of a cooler drive at a downstream end of the finishing stretch such that the wire exits the cooler drive substantially at the travel speed $V_D$;

passing the wire through a looping stretch downstream of the cooler drive to a looper drive;

operating the looper drive at such a speed that the wire forms a loop between the cooler drive and the looper drive and exits the looper drive at a constant looper speed $V_T$; and forming the wire into turns and depositing the turns as a coil downstream of the looper drive.

2. The wire-making method defined in claim 1 further comprising the steps of:

sensing a vertical height of the loop; and varying the speed of the looper drive to maintain the height between upper and lower limits.

3. The wire-making method defined in claim 1 the wire is coiled at a speed dependent on the looper speed $V_T$.

4. The wire-making method defined in claim 1, further comprising the step of maintaining the wire under tension in the stretch between the finishing stand and the cooler drive.

5. The wire-making method defined in claim 4 wherein tension is maintained in the stretch between the finishing stand and cooler drive by providing a second cooler drive in the stretch.

6. A method of making wire comprising the steps of:

rolling out a wire in a mill having a finishing stand from which the wire exits at a predetermined and varying travel speed $V_D$;

pulling the wire through a cooling/equalizing stretch downstream in a travel direction from the finishing stand by means of a cooler drive at a downstream end of the finishing stretch such that the wire exits the cooler drive substantially at the travel speed $V_D$;

passing the wire through a looping stretch downstream of the cooler drive to a looper drive;

operating the looper drive at such a speed that the wire forms a loop in the looping stretch between the cooler drive and the looper drive and exits the looper drive at a looper speed $V_T$;

forming the wire into turns and depositing the turns at a coiler speed as a coil downstream of the looper drive;

detecting a height of the loop;

increasing the looper speed and coiler speed when the detected height exceeds a predetermined limit; and decreasing the looper speed and coiler speed when the detected height goes below a predetermined limit.

7. A system for making wire, the system comprising:

a mill having a finishing stand and operable to produce wire that exits the finishing stand at a predetermined and varying travel speed $V_D$;

means including a cooler drive downstream in a travel direction from the finishing stand for pulling the wire through a cooling/equalizing stretch between the finishing stand and the cooler drive that the wire exits the cooler drive substantially at the travel speed $V_D$;

means including a looper drive downstream from the cooler drive for passing the wire through a looping stretch between the cooler drive and the looper drive;

control means for operating the looper drive at such a speed that the wire forms a loop between the cooler drive and the looper drive and exits the looper drive at a substantially constant looper speed $V_T$; and means downstream of the looper drive for forming the wire into turns and depositing the turns as a coil downstream of the looper drive.

8. The wire-making system defined in claim 7, further comprising sensor means for detecting a vertical height of the loop.

9. The wire-making system defined in claim 7 wherein the control means includes means for varying the speed of the looper drive when the detected vertical height exceeds a predetermined upper limit or goes below a predetermined lower limit.

10. The wire-making system defined in claim 7 wherein the control means includes means for varying a speed of the coiler when the detected vertical height exceeds a predetermined upper limit or goes below a predetermined lower limit.

11. The wire-making system defined in claim 7 wherein the control means operates the coiler at a speed dependent on the looper speed $V_T$.

12. The wire-making system defined in claim 7, further comprising another looper drive in the stretch for maintaining the wire in the stretch under tension.

* * * * *